US006772114B1

(12) United States Patent
Sluijter et al.

(10) Patent No.: US 6,772,114 B1
(45) Date of Patent: Aug. 3, 2004

(54) HIGH FREQUENCY AND LOW FREQUENCY AUDIO SIGNAL ENCODING AND DECODING SYSTEM

(75) Inventors: Robert Johannes Sluijter, Eindhoven (NL); Andreas Johannes Gerrits, Eindhoven (NL); Rakesh Taori, Eindhoven (NL); Samir Chennoukh, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 455 days.

(21) Appl. No.: 09/710,916

(22) Filed: Nov. 13, 2000

(30) Foreign Application Priority Data

Nov. 16, 1999 (EP) ..... 99203819

(51) Int. Cl.[7] ..... G10L 19/00
(52) U.S. Cl. ..... 704/220; 704/262
(58) Field of Search ..... 704/200, 200.1, 704/201, 205, 228, 261–269

(56) References Cited

U.S. PATENT DOCUMENTS 5,581,652 A * 12/1996 Abe et al. ..... 704/222
5,710,863 A * 1/1998 Chen ..... 704/200.1
5,774,837 A 6/1998 Yeldener et al. ..... 704/208
5,867,815 A * 2/1999 Kondo et al. ..... 704/228
6,078,880 A * 6/2000 Zinser et al. ..... 704/208
6,233,550 B1 * 5/2001 Gersho et al. ..... 704/208

FOREIGN PATENT DOCUMENTS

EP 0648024 A1 12/1995 ..... H04B/1/66

OTHER PUBLICATIONS

"A 13 KBIT/S Wideband Speech CODEC Based on SB–ACELP" J. Schnitzler, IEEE International Conference on Acoustics, Seattle Wa, vol. Conf. 23, May 12–15, 1998 p. 157–160.
"Hi–BIN: an Alternative Approach to Wideband Speech Coding" Taori et al, IEEE International Conference on Acoustics, Speech and Signal Processing, Istambul, Turkey, vol. 2, Jun. 5–9, 2000, p. 1157–1160.

* cited by examiner

*Primary Examiner*—Richemond Dorvil
*Assistant Examiner*—Abulk Azad

(57) ABSTRACT

In an audio transmission system, an input signal is split up into two spectral portions in a transmitter. These spectral portions are coded by their own respective coder. The low-frequency signal portion is coded by a regular narrow-band coder and the high frequency portion is coded using a coder that outputs LPC codes and signal amplitude codes. In the receiver, the low frequency signal portion is reconstructed by a narrow-band decoder and the high frequency portion is reconstructed by applying a high pass filter to a white noise signal and applying an LPC filter that is controlled by the LPC codes to this filtered white noise signal and adjusting the signal amplitude with an amplifier that is controlled using the amplitude codes of the transmitter. The reconstructed low frequency signal and the reconstructed high frequency signal are then combined to yield a reconstructed output signal containing both frequency ranges.

21 Claims, 2 Drawing Sheets

HIGH FREQUENCY AND LOW FREQUENCY AUDIO SIGNAL ENCODING AND DECODING SYSTEM

BACKGROUND OF THE INVENTION

1. Field of the Invention

The invention relates to a transmission system employing a transmitter including a splitter for splitting up a transmission signal into a signal having a low frequency range and a signal having a high frequency range, and a first coding device for deriving a coded signal having a low frequency range from the signal having a low frequency range. The first coding device is arranged for transmitting the coded signal having a low frequency range to a receiver by a first transmission channel. The receiver employs a first decoder for forming a reconstructed signal having a low frequency range based on the coded signal having a low frequency range. The transmitter further employs a second coding device for deriving a coded signal having a high frequency range from the signal having a high frequency range, which second coding device is arranged for transmitting the coded signal having a high frequency range from the transmitter to the receiver by a second transmission channel. The receiver further employs a second decoder for forming a reconstructed signal having a high frequency range based on the coded signal having a high frequency range by using a noise signal coming from a noise signal source, and a combiner for combining the reconstructed signal having a low frequency range and the reconstructed signal having a high frequency range.

The invention further relates to a transmitter, a receiver, a coding device, a decoder, a coding method and a decoding method to be used in a transmission system of such type.

2. Description of the Relation Art

A prior art transmission system is known from EP 0 648 024 A1. This document describes a transmission system for audio signals in which the input signal is split up into spectral portions by a filter bank. These spectral portions are coded each by its own coding device, a sub-coder. In the sub-coder, the envelope of a signal is determined and this envelope is compared with a number of reference envelopes. An identification code of the reference envelope corresponding best to the envelope is transmitted to a receiver.

In the receiver, a decoder reconstructs a signal on the basis of the identification code, the envelope of which signal corresponds to the received reference envelope, after which the envelope is multiplied by a noise signal coming from a noise source, which results in a reconstructed spectral portion of the input signal. Subsequently, these reconstructed spectral portions are combined to thus form a reconstruction of the input signal.

A disadvantage of such a transmission system is that the coding device needs to have considerable computation capacity for the splitting up of the input signal into spectral portions by a filter bank in the transmitter and the combining of the spectral portions in the receiver with the aid of a combiner.

SUMMARY OF THE INVENTION

It is an object of the invention to provide a transmission system in which the necessary computation capacity is reduced.

For this purpose, the transmission system according to the invention is characterized in that a coding device comprises analysis means for determining prediction coefficients and for transmitting the prediction coefficients to a receiver and in that a decoding device is arranged for filtering the noise signal coming from the noise signal source during the reconstruction of the signal having a high frequency range by means of an LPC synthesis filter which is controlled by the prediction coefficients.

The input signal is split up into two portions, so that an optimum coding for each of the two frequency ranges can be selected. A first coding device utilizes a known coding, which is efficient for a signal having a low frequency range, at an associated efficient bit rate. A low-pass filler is sufficient for this signal. A second coding device utilizes the Linear Predicive Coding (LPC) to code the signal having a high frequency range in an efficient manner. Thanks to the properties of the LPC coding, a high-pass filter is sufficient and it is not necessary to apply down-sampling. Since the high-pass filter and the low-pass filter both require little computation capacity, and a down-sampler is omitted, the total required computation capacity is reduced.

The human auditory system in this high frequency range is considerably less precise, so that it is possible during the reconstruction of the signal having a high frequency range, to take a white noise source as a signal source and subsequently fitter the signal source with an LPC synthesis filter, so that a signal is obtained whose spectrum to the human auditory system sufficiently matches the original signal. Since it is avoided that the high frequency range is subdivided into smaller frequency ranges, which are to be processed separately, the required computation capacity is reduced.

An embodiment of the transmission system according to the invention is characterized in that the second coding device in the transmitter is arranged for generating an amplification code based on the signal having a high frequency range and in that the second decoder in the receiver is arranged for utilizing the amplification codes during the reconstruction of the signal having a high frequency range.

Since the coding device determines an amplification code by which the decoder subsequently amplifies the reconstructed signal, the number of prediction coefficients required is reduced, so that determining the prediction coefficients becomes simpler and requires less computation capacity.

The frequency ranges can be determined.

BRIEF DESCRIPTION Of THE DRAWINGS

The invention will be further described with reference to the Figures in which.

DETAILED DESCRIPTION OF THE PRESENTLY PREFERRED EMBODIMENT

Figure 1:
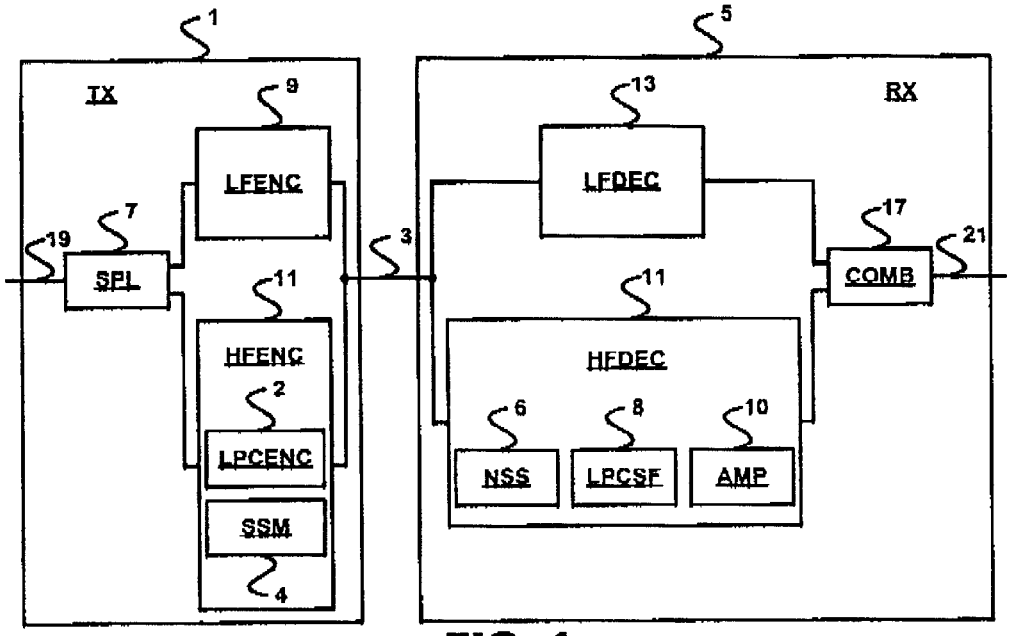
FIG. 1 shows a transmission system according to the invention.

FIG. 1 diagrammatically shows a transmission system according to the invention.

The input signal arrives through an input 19 of a transmitter ("TX") 1. A splitter ("SPL") 7 splits up the input signal 19 into a signal that has a low frequency range and is processed by a first coder ("LFENC") 9, and a signal that has a high frequency range and is processed by a second coder ("HFENC") 11, the second coder 11 utilizing an LPC coder ("LPCENC") 2 and a signal strength meter ("SSM") 4. The coder 11 is an LPC coder, which determines prediction coefficients of the signal that has a high frequency range. The coded signals appear on the output of the first coder 9 and the second coder 11 and are transmitted to a receiver ("RX") 5 by a transmission channel 3. In this receiver 5, the coded signal having a low frequency range is processed by a first decoder ("LFDEC") 13 and the coded signal having a high frequency range is processed by a second decoder ("HFDEC") 15, while use is made of a noise signal source ("NSS") 6, an LPC synthesis filter ("LPCSF") 8 and an amplifier ("AMP") 10. The decoded signal having a low frequency range and the decoded signal having a high frequency range are then combined by a combiner ("COMB") 17 to an output signal that is rendered available on an output 21 of the receiver 5.

Figure 2:
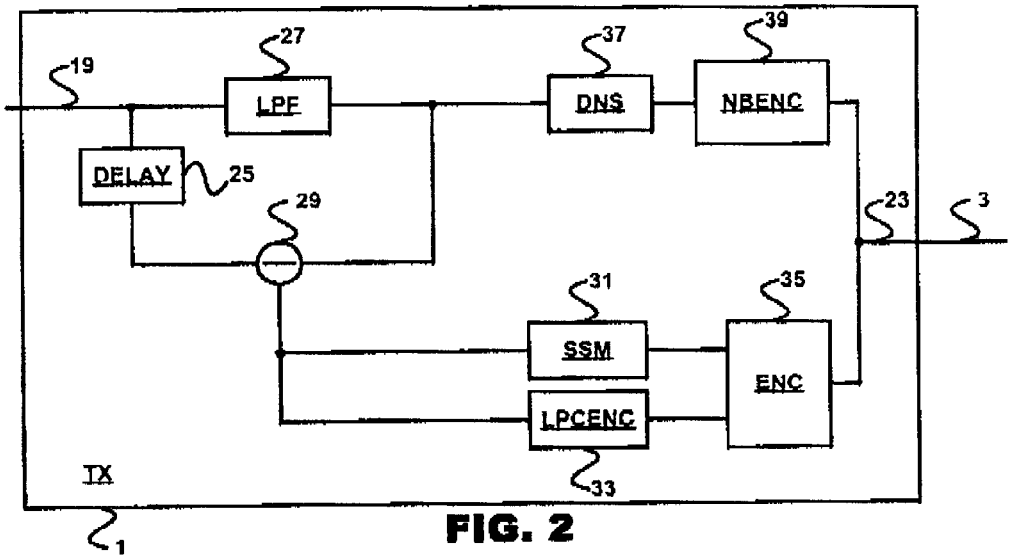
FIG. 2 shows a transmitter according to the invention.

FIG. 2 shows an embodiment of transmitter 1 (FIG. 1) according to the invention.

The input signal arrives through the input 19 of transmitter 1. The input signal is split up into two spectral portions, the signal having a low frequency range being the result of the processing of the input signal with the low-pass filter ("LPF") 27, and the signal having a high frequency range being the result of determining the difference between the signal having a low frequency range coming from the low-pass filter 27 and the input signal delayed by a delay element ("DELAY") 25. The difference signal is determined by the subtracter 29. It is important for the low-pass filter 27 to have a linear phase characteristic. This may be achieved, for example, by using a finite impulse response filter having a length of 81 as a low-pass filter, so that the filtered signal is delayed by 40 samples. For speech may be chosen a passband frequency range between 0 and 3.4 kHz and a stop band from 4 to 8 kHz. The delay element 25 is used for compensating for the delay that occurs in the finite impulse response filter, so that the signals available at the subtracter 29 have the right phase relation.

The difference signal is then applied to a signal strength meter ("SSM") 31, which measures the signal strength of the difference signal and generates amplification codes in response thereto. The signal strength is determined for sub-frames having a length from 0.5 . . . 10 ms of the signal having a high frequency range.

By means of a Hamming window h, the signal strength is determined based on the following equation [1]:

$$p_1 = \frac{1}{80}\sum_{n=0}^{79} h[n]s^2[n] \qquad [1]$$

where s is a 5 ms sub-frame and i the position in the frame. Four signal strengths are computed within one frame, thus i=1, 2, 3, 4.

For quantization purposes, the four signal strengths are converted to a logarithmic domain in accordance with the following equation [2]:

$$l_i = 10\log_{10} p_i \text{ where } i=1,2,3,4. \qquad [2]$$

The first signal strength $l_1$ is quantized with four bits, whereas the lust three signal strengths $l_2$ to $l_4$ are quantized differentially relative to the previously quantized signal strength with three bits.

The value of $l_1$ may be limited to a fixed range, for example, a range from −10 to 60 dB for 16-bit signals and is then quantized with 4 bits, which results in a quantized signal strength $\hat{l}_i$ and an index $I_{l_i}$. The remaining signal strengths are quantized differentially in accordance with the following equation [3]:

$$\Delta_i = l_i - \hat{l}_{i-1} \qquad [3]$$

This differential quantization $\Delta_i$ may be limited to a range from, for example, −6 dBm to +6 dBm. The index representing this differential quantization is $I_{l_i}$. The quantized signal strength $\hat{l}_i$ is to be determined in accordance with the following equation [4] to be able to compute $\Delta_{i+1}$:

$$\hat{l}_i = \hat{l}_{i-1} + \hat{\Delta}_i \qquad [4]$$

The amplification codes comprise the indices $I_{l_i}$.

The decoder determines the quantized signal strengths in the same manner.

The difference signal is also applied to an LPC coder ("LPCENC") 33, which determines the prediction codes of the difference signal with the aid of an LPC analysis. The low frequency range in the difference signal is absent, so that down-sampling of the signal is not necessary. When the signal having a high frequency range is reconstructed by an LPC synthesis filter, a frequency characteristic having a sufficiently low amplitude level arises of its own accord in the low frequency range. With the aid of a sixth-order LPC analysis, the six LPC coefficients can be determined of a 15 ms segment of the signal having a high frequency range. For determining these six LPC coefficients, the average value of the segment is determined and subtracted from the samples in the segment, after which a 240-dot Hamming window function is applied. Subsequently, the Levinson-Durbin recursion is applied to the autocorrelation function of the windowed signal. To avoid sharp resonances, bandwidth expansion is used for which an expansion factor of 0.98 can be used.

The six LPC coefficients are converted to Line Spectral Frequencies (LSF) ω[n] (n=0,1,2 . . . ,5) in preparation for vector quantization. The quantized LSFs are based on their sensitivity to quantization errors. The sensitivity increases as the distance between neighboring LSFs decreases.

This is used by utilizing a weighing function Φ in accordance with the following equation [5]:

$$\Phi[n] = \begin{cases} \dfrac{1}{\omega[1]-\omega[0]} & \text{If } n=0 \\ \dfrac{1}{\omega[5]-\omega[4]} & \text{if } n=5 \\ \dfrac{1}{\min(\omega[n]-\omega[n-1],\ \omega[n+1])} & \text{if } 1 \le n \le 4 \end{cases} \qquad [5]$$

A single codebook c comprising 1024 predefined $6^{th}$-order LSF vectors is used for the vector quantizer, the LSF vectors being obtained by training the codebook c with the LBG algorithm.

For each element j of the codebook c the following distance function is evaluated in accordance with the following equation [6]:

$$D_j = \sum_{n=0}^{5} \Phi[n]\cdot(\omega[n]-c_l[n])^2 \qquad [6]$$

The index of the codebook element having the shortest distance is selected. This LSF codebook index is sent to the decoder.

The signal having a low frequency range coming from the low-pass filter 27 is down-sampled by a down-sampler ("DNS") 37 and applied to a narrow-band coder ("NBENC")39. This narrow-band coder 39 is a normal coder optimized for a signal having a low frequency range as described, for example, in ITU G.729 or G.728. The type or operation of this narrow-band coder 39 is unimportant to the implementation of the invention. The narrow-band coder 39 generates coded signals that, together with the amplification codes coming from the signal strength meter 31 and the coded signals coming from the LPC coder 33 via coder ("ENC") 35, are available on an output 23 of the transmitter 1 for further processing.

Figure 3:
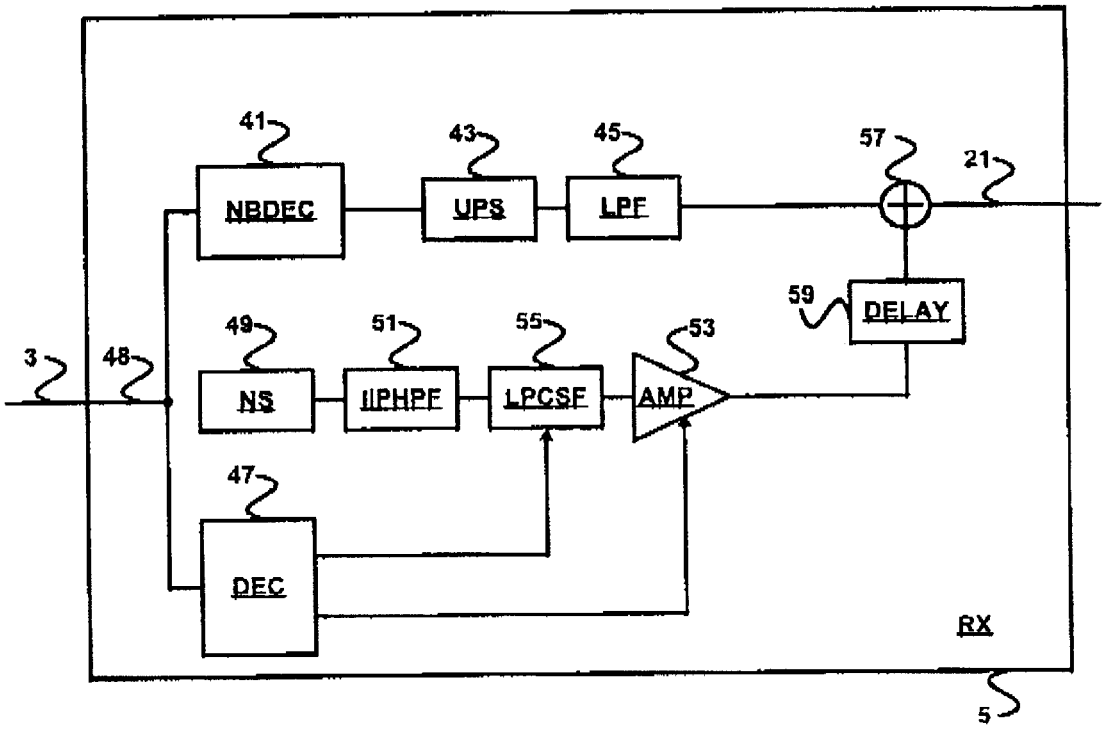
FIG. 3 shows a receiver according to the invention.

FIG. 3 shows an embodiment of receiver 5 (FIG. 1) according to the invention.

The coded signals arriving through an input 48 of the transmission channel are applied to a narrow-band decoder ("NODEC") 41 and a decoder ("DEC") 47, while each decoder processes the coded signals and amplification codes intended for it.

By the narrow-band coder 41, a reconstructed signal having a low frequency range is recovered from the coded signal having a low frequency range after which up-sampling takes place by an up-sampler ("UPS") 43. To avoid undesired signals in the high frequency range, which may be developed during decoding or up-sampling, the reconstructed signal, after up-sampling, is filtered by a low-pass filter ("LPF") 45, which has a frequency characteristic that can be compared with the low-pass filter 27 in the transmitter.

The coded signal having a high frequency range and the amplification codes are convened by a decoder 47 into control signals for an LPC synthesis filter ("LPCSF") 55 and for an amplifier ("AMP") 53 by which the frequency characteristic and signal strength of the reconstructed signal can be adapted.

A noise source ("NS") 49 produces a white noise signal. The white noise signal includes noise segments of 80 samples in length, which are generated by a random pulse generator having a uniform random pulse distribution. This noise signal is processed by a sixth-order Infinite Impulse Response high-pass filter ("IIRHPF") 51 that has a 3500 Hz cut-off frequency, so that a filtered noise signal arises which has a frequency range that is comparable to the frequency range of the signal having a high frequency range.

The amplitude spectrum of the filtered noise signal coming from the high-pass filter 51 is adapted by an LPC synthesis filter 55 to the amplitude spectrum of the signal having a high frequency range. The LPC parameters necessary for setting the LPC synthesis filter 55 are obtained by selecting the right LSFs from the codebook with the aid of a received LPC codebook index and converting these LSFs into LPC parameters.

During the reconstruction of the signal having a high frequency range by an LPC synthesis filter, an amplitude spectrum having a sufficiently low amplitude level will arise of its own accord in the low frequency range.

The filtered noise signal coming from the LPC synthesis filter 55 is amplified by the amplifier 53, which is set to the indices in the received amplification codes. This achieves that the signal strength of the reconstructed signal having a high frequency range is adapted to the signal strength of the signal having a high frequency range. The signal strength is indicated in the amplification code by the received indices $I_i$ (i=1, . . . ,4). The indices are decoded and then converted from the logarithmic domain to the linear domain:

$$\hat{p}_i = 10^{\frac{\bar{I}_i}{10}}$$

The filtered noise signal is subdivided into 5 ms sub-frames. Per sub-frame s', the signal strength is determined by the following equation [7]:

$$p'_i = \frac{1}{80}\sum_{n=0}^{79} h[n]\cdot s'^2[n] \qquad [7]$$

where h is a Hamming window.

The scale factor $g_i$ for the sub-frame I is determined in accordance with the following equation [8]:

$$g_i = \sqrt{\frac{\hat{p}_f}{p'_i}} \qquad [8]$$

The segments of the noise signal are scaled, that is to say, amplified by a factor $g_i$ and, with an overlap, combined to form the high frequency reconstructed signal.

Since it is possible for various signal delays to arise during the reconstruction of the signal having a high frequency range and the signal having a low frequency range, a delay element ("DELAY") 59 is provided for delaying the signal coming from the amplifier 53. In the case where the signal having a low frequency range experiences less delay than the signal having a high frequency range, the delay element 59 may be inserted between the low-pass filter 45 and the combiner 57.

The reconstructed signal having a low frequency range coming from the low-pass filter 45, and the reconstructed signal having a high frequency range coming from the delay element 59 are combined by a combiner 57 to an output signal that is rendered available on an output 21 of the receiver. Since the frequency characteristic of the reconstructed signal having a low frequency range and the reconstructed signal having a high frequency range shows little overlap, the output signal having a complete frequency range can be obtained by simply adding up the two reconstructed signals.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A transmission system, comprising:

a transmitter including a splitter for splitting up a transmission signal into a low frequency signal within a low frequency range and a high frequency signal within a high frequency range, the low frequency range being lower than the high frequency range, wherein said splitter applies a low-pass filter to the transmission signal to generate the low frequency signal, wherein said splitter applies a delay to the transmission signal to generate a delayed transmission signal, and wherein said splitter determines a difference between the low frequency signal and the delayed transmission signal to generate the high frequency signal, a first coder for deriving a first coded signal within the first frequency range from the low frequency signal, and a second coder for deriving a second coded signal within the high frequency range from the high frequency signal;

a receiver in electrical communication with said transmitter to receive the first coded signal and the second coded signal, said receiver including a first decoder for forming a first reconstructed signal within the first frequency range based on the first coded signal, and a second decoder for forming a second reconstructed signal within the second frequency range based on the second coded signal and a noise signal.

2. The transmission system of claim 1, wherein said first coder sequentially applies a down-sampler and a narrow-band coder to generate the first coded signal.

3. The transmission system of claim 1, wherein said second coder measures a signal strength of the high frequency signal to generate an amplification code;

wherein said second coder determines prediction coefficients based on the high frequency signal; and wherein the second coded signal codes the amplification code and the prediction coefficients as components of the second coded signal.

4. The transmission system of claim 2, wherein the first decoder sequentially applies a narrow-band decoder, an up-sampler and a low-pass filter to the first coded signal to generate the first reconstructed signal.

5. The transmission system of claim 2, wherein, based on the second coded signal, the second decoder sequentially applies a high-pass filter, a LPC synthesis filter and an amplifier to the noise signal to generate the second reconstructed signal.

6. The transmission system of claim 5, wherein said second coder measures a signal strength of the high frequency signal to generate an amplification code;

wherein said second coder codes the amplification code as one component of the second coded signal; and wherein said second decoder uses the amplification code to set said amplifier.

7. The transmission system of claim 5, wherein said second coder determines prediction coefficients based on the high frequency signal;

wherein said second coder codes the prediction coefficients as one component of the second coded signal, and wherein said second decoder uses the prediction coefficients to control said LPC synthesis filter.

8. The transmission system of claim 2, further comprising:

a combiner for combining the first reconstructed signal and the second reconstructed signal.

9. The transmission system of claim 8, wherein said receiver applies a delay to one of the first reconstructed signal and the second reconstructed signal prior to said combiner combining the first reconstructed signal and the second reconstructed signal.

10. A transmission system, comprising:

a transmitter including a splitter for splitting up a transmission signal into a low frequency signal within a low frequency range and a high frequency signal within a high frequency range, the low frequency range being lower than the high frequency range, a first coder for deriving a first coded signal within the first frequency range from the low frequency signal, and a second coder for deriving a second coded signal within the high frequency range from the high frequency signal;

a receiver in electrical communication with said transmitter to receive the first coded signal and the second coded signal, said receiver including a first decoder for sequentially applying a narrow-band decoder, an up-sampler and a low-pass filter to the first coded signal to generate a first reconstructed signal within the first frequency range, and a second decoder, wherein, based on the second coded signal, said second decoder sequentially applies a high-pass filter, a LPC synthesis filter and an amplifier to a noise signal to generate the second reconstructed signal.

11. The transmission system of claim 10, wherein said first coder sequentially applies a down-sampler and a narrow-band coder to generate the first coded signal.

12. The transmission system of claim 10, wherein said second coder measures a signal strength of the high frequency signal to generate an amplification code;

wherein said second coder determines prediction coefficients based on the high frequency signal; and wherein the second coded signal codes the amplification code and the prediction coefficients as components of the second coded signal.

13. The transmission system of claim 10, wherein said second coder measures a signal strength of the high frequency signal to generate an amplification code;

wherein said second coder codes the amplification code as one component of the second coded signal; and wherein said second decoder uses the amplification code to set said amplifier.

14. The transmission system of claim 10, wherein said second coder determines prediction coefficients based on the high frequency signal;

wherein said second coder codes the prediction coefficients as one component of the second coded signal, and wherein said second decoder uses the prediction coefficients to control said LPC synthesis filter.

15. The transmission system of claim 10, further comprising:

a combiner for combining the first reconstructed signal and the second reconstructed signal.

16. The transmission system of claim 15, wherein said receiver applies a delay to one of the first reconstructed signal and the second reconstructed signal prior to said combiner combining the first reconstructed signal and the second reconstructed signal.

17. A transmitter, comprising:

a splitter for splitting up a transmission signal into a low frequency signal within a low frequency range and a high frequency signal within a high frequency range, the low frequency range being lower than the high frequency range, wherein said splitter applies a low-pass filter to the transmission signal to generate the low frequency signal, wherein said splitter applies a delay to the transmission signal to generate a delayed transmission signal, and wherein said splitter determines a difference between the low frequency signal and the delayed transmission signal to generate the high frequency signal;

a first coder for deriving a first coded signal within the first frequency range from the low frequency signal; and a second coder for deriving a second coded signal within the high frequency range from the high frequency signal.

18. The transmitter of claim 17, wherein said first coder sequentially applies a down-sampler and a narrow-band coder to generate the first coded signal.

19. The transmission system of claim 17, wherein said second coder measures a signal strength of the high frequency signal to generate an amplification code;

wherein said second coder determines prediction coefficients based on the high frequency signal; and wherein the second coded signal codes the amplification code and the prediction coefficients as components of the second coded signal.

20. A receiver, comprising:

a first decoder receiving a first coded signal with a low frequency range, said first decoder for sequentially applying a narrow-band decoder, an up-sampler and a low-pass filter to the first coded signal to generate a first reconstructed signal within the low frequency range;

a second decoder receiving a second coded signal within a high frequency range that is higher the low frequency range wherein, based on the second coded signal, said second decoder sequentially applies a high-pass filter, a LPC synthesis filter and an amplifier to a noise signal to generate a second reconstructed signal within the high frequency range; and a combiner for combining the first reconstructed signal and the second reconstructed signal.

21. The receiver of claim 20, wherein said receiver applies a delay to one of the first reconstructed signal and the second reconstructed signal prior to said combiner combining the first reconstructed signal and the second reconstructed signal.

* * * * *